US005327732A

United States Patent [19]

De Almeida

[11] Patent Number: 5,327,732

[45] Date of Patent: Jul. 12, 1994

[54] APPARATUS FOR SUPPLYING CRYOGENIC FLUID, NAMELY NITROGEN, TO EXTINGUISH FIRES

[75] Inventor: Fernando J. N. De Almeida, Linda-A-Velha, Portugal

[73] Assignees: Fernando Martins da Silva; Jorge Maria Bello de Sousa Rego; James Edward Risso-Gill, all of Lisboa, Portugal

[21] Appl. No.: 875,279

[22] Filed: Apr. 28, 1992

[30] Foreign Application Priority Data

Oct. 8, 1991 [PT] Portugal ..... 99 175

[51] Int. Cl.[5] ..... F17C 9/02

[52] U.S. Cl. ..... 62/50.2; 62/53.2; 169/69

[58] Field of Search ..... 62/50.1, 50.2, 53.2; 169/69

[56] References Cited

U.S. PATENT DOCUMENTS 3,302,418 2/1967 Walter ..... 62/50.2

4,175,395 11/1979 Prost et al. ..... 62/50.2

*Primary Examiner*—Ronald C. Capossela

*Attorney, Agent, or Firm*—Hale and Dorr

[57] ABSTRACT

The present invention relates to a high capacity movable plant for continuously distributing nitrogen in gaseous phase or in a mixture gaseous and liquid phases for extinguishing fires comprising at least a high capacity thermally insulated tank for storing nitrogen in liquid phase at a temperature of about −196° C. and at maximum pressure of about 405.2 kPa and from which nitrogen in liquid phase is supplied, with a liquid nitrogen supplying capacity of about 50 $m^3$, to a pumping unit comprising at least three pumps each having each a flow rate of 175 $m^3/h$ with a maximum differential pressure of 1013 kPa. The liquid nitrogen is vaporized in the vaporization and mixture regulation unit with a vaporization capacity of about 360,000 $m^3/h$ for liquid nitrogen. The vaporization and mixture regulation unit includes at least a heat exchanger, a wind tunnel, a ventilation assembly, an air inlet window through which the liquid nitrogen is vaporized and the gaseous phase can be mixed with the liquid phase through suitably arranged valves and ejectors. The nitrogen in the gaseous phase or the mixture of nitrogen in the gaseous and liquid phase enters an exhaust duct where the temperature can vary from −100° C. and +20° C. and the pressure can vary from 588 to 1986 KPa. The plant also includes a power station for powering the plant and a control and command unit to command which uses a microprocessor to assure the automatic and sequential operation of the plant.

3 Claims, 6 Drawing Sheets

APPARATUS FOR SUPPLYING CRYOGENIC FLUID, NAMELY NITROGEN, TO EXTINGUISH FIRES

BACKGROUND OF THE INVENTION

The present invention relates to an apparatus, preferably movable, for the application of cryogenic liquids, preferably, liquid nitrogen for extinguishing fires in general, and in particular in oil wells on land or at sea.

As far as known by the applicant, there are no existing systems, movable or fixed, for the application of cryogenic liquids in the prior art where flows of about 360,000 cubic meters/hour are required, pressures of about 294 to 2450 kPa and temperatures of about 100° C.

The creation of an insulating barrier between a combustible on fire and the oxygen, together with the cooling effect of the combustible and the environment surrounding the flames, are wellknown techniques of extinguishing fires, however, up to the present, the great difficulty has been to achieve and create such conditions in case of fires in oil wells, especially in over atmospheric oil wells.

OBJECTIVE OF THE INVENTION

The object of the present invention is to provide a high capacity movable plant for supplying a cryogenic fluid, which is preferably nitrogen, in gaseous phase or in a mixture of gaseous and liquid phases to an apparatus for extinguishing fires.

It is also an object of the present invention to provide an apparatus for supplying nitrogen to extinguish fires in which nitrogen in gaseous and liquid phases is expanded and injected by means of the apparatus upon, under and around the nucleus of the fire, thereby insulating the fire nucleus completely from the atmospheric air, and causing the convenient cooling of the fire nucleus, avoiding any possibility of self-ignition.

SUMMARY OF THE INVENTION

The movable apparatus or plant for supplying nitrogen according to the present invention comprises:

a high capacity, thermally insulated tank for storing nitrogen in liquid phase at a maximum pressure of about 405.2 kPa and at a temperature of about −196° C., comprising a first nitrogen inlet for filling the tank with nitrogen in the liquid phase, an outlet for transferring the nitrogen in the liquid phase, and a second nitrogen inlet for filling the tank with nitrogen in the gaseous phase to compensate for the volume of nitrogen supplied through the outlet in the liquid phase, control devices, safety devices;

a pumping unit to pump nitrogen in the liquid phase out of the tank which includes three pumps, a liquid nitrogen outlet duct, a liquid nitrogen input duct and a temperature probe;

a vaporization of mixture regulation unit for nitrogen in liquid and gaseous phases, comprising interconnection pipes to the pumping unit for carrying the nitrogen in the liquid phase, a heat exchanger to vaporize the nitrogen in the liquid phase, a ventilation assembly to speed up and maintain the vaporization of the nitrogen in the liquid phase and for supplying the heat needed for vaporization, control valves to increase or reduce the flow rate through the heat exchanger, a phase mixture regulation arrangement formed by the control valves, mixture regulating valves and mixture ejectors, an outlet duct for transferring nitrogen in the gaseous phase and/or in a mixture of phases, control devices, distribution circuits for connecting the vaporization of mixture regulation unit to a fire extinguishing apparatus;

command and control unit to command and control the plant which unit comprises a microprocessor to assure the automatic and sequential operation of the plant, electric control and command circuits and pneumatic control and command circuits comprising pilot circuits for the tank valves, command circuits for the pumping unit, command and control circuits for the vaporization and mixture regulation unit for nitrogen in gaseous and liquid phases and the power station; and safety devices to assure the safe running of, or for stopping, the plant comprising at least safety valves, alarms, gauges, break and protection devices;

BRIEF DESCRIPTION OF THE DRAWINGS

The invention will be better understood from the following detailed description of a preferred embodiment, given as a non-limiting example, taken in connection with the accompanying drawings in which.

DETAILED DESCRIPTION OF THE PREFERRED EMBODIMENT OF THE INVENTION

Figure 1A:
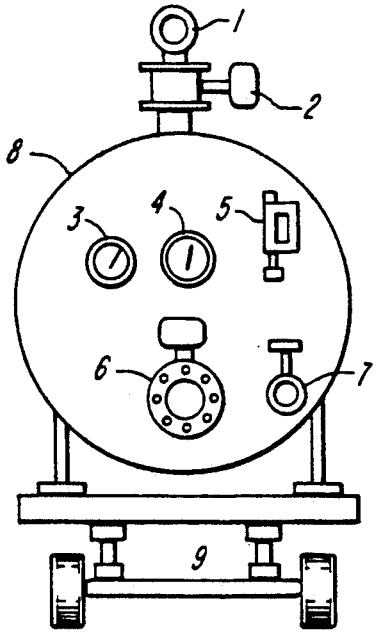
FIG. 1*a* is a front elevational view of the liquid nitrogen supply unit of the plant of the present invention for supplying liquid nitrogen.
Figure 1B:
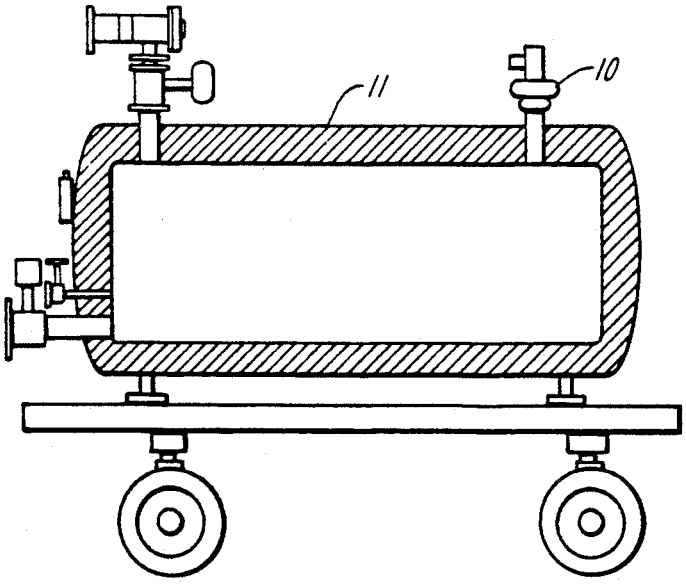
FIG. 1*b* is a side sectional view of the liquid nitrogen tank of the plant for supplying liquid nitrogen shown in FIG. 1*a;*
Figure 2A:
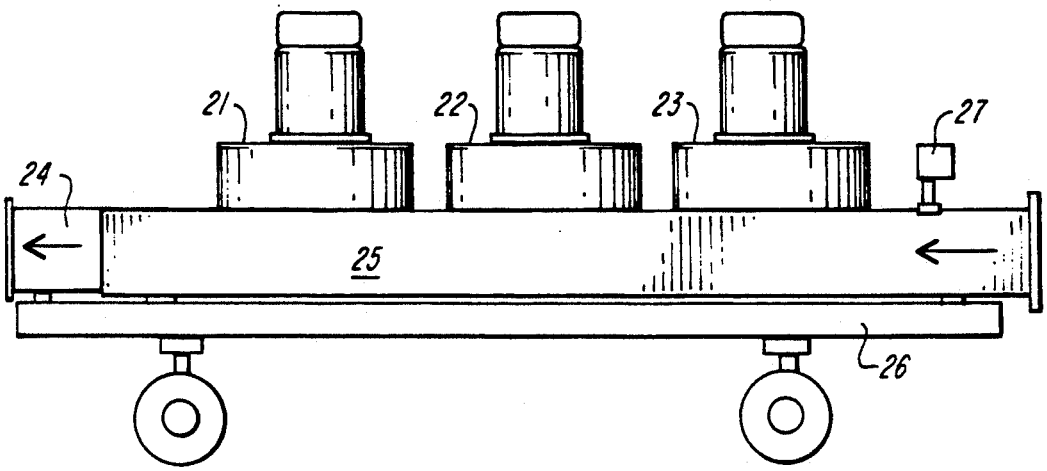
FIG. 2*a* is a side elevational view of the pumping unit of the plant for supplying liquid nitrogen according to the present invention.
Figure 2B:
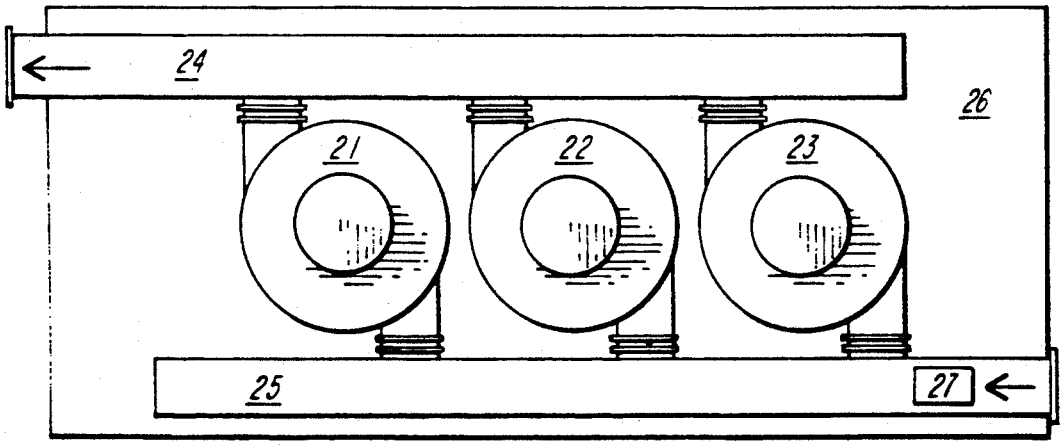
FIG. 2*b* is a top view of the pumping unit shown in FIG. 2*a;*
Figure 3A:
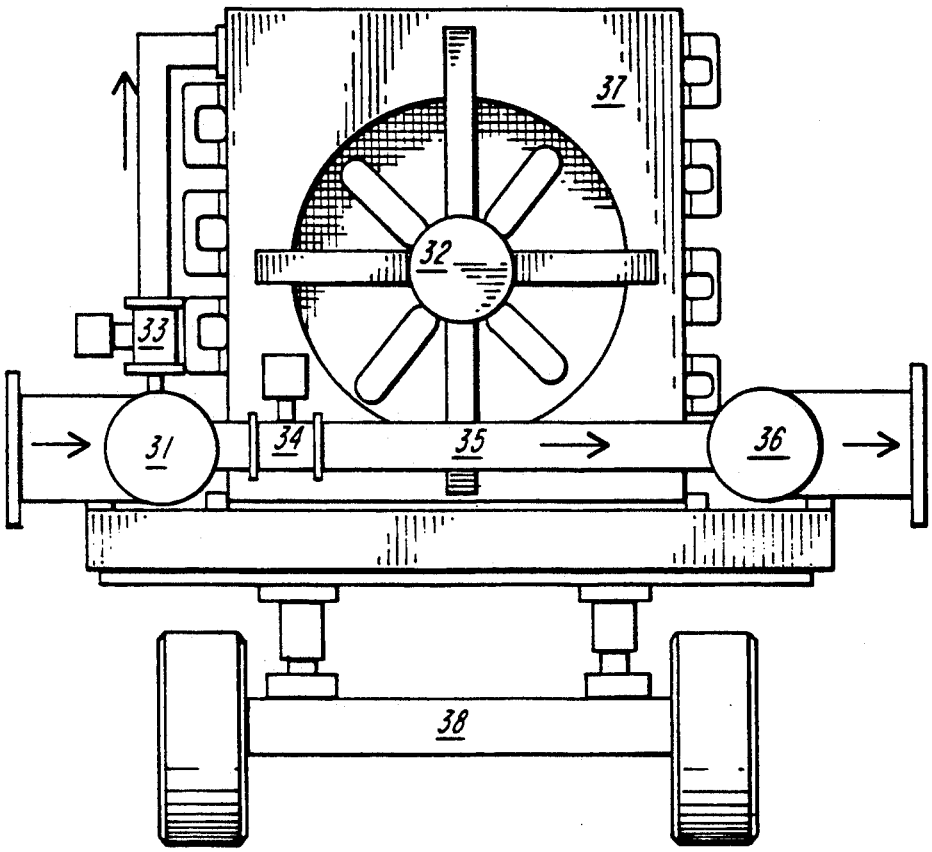
FIG. 3*a* is a rear elevational view of the vaporization and mixture regulation unit of the plant for continuously supplying nitrogen, according to the present invention.
Figure 3B:
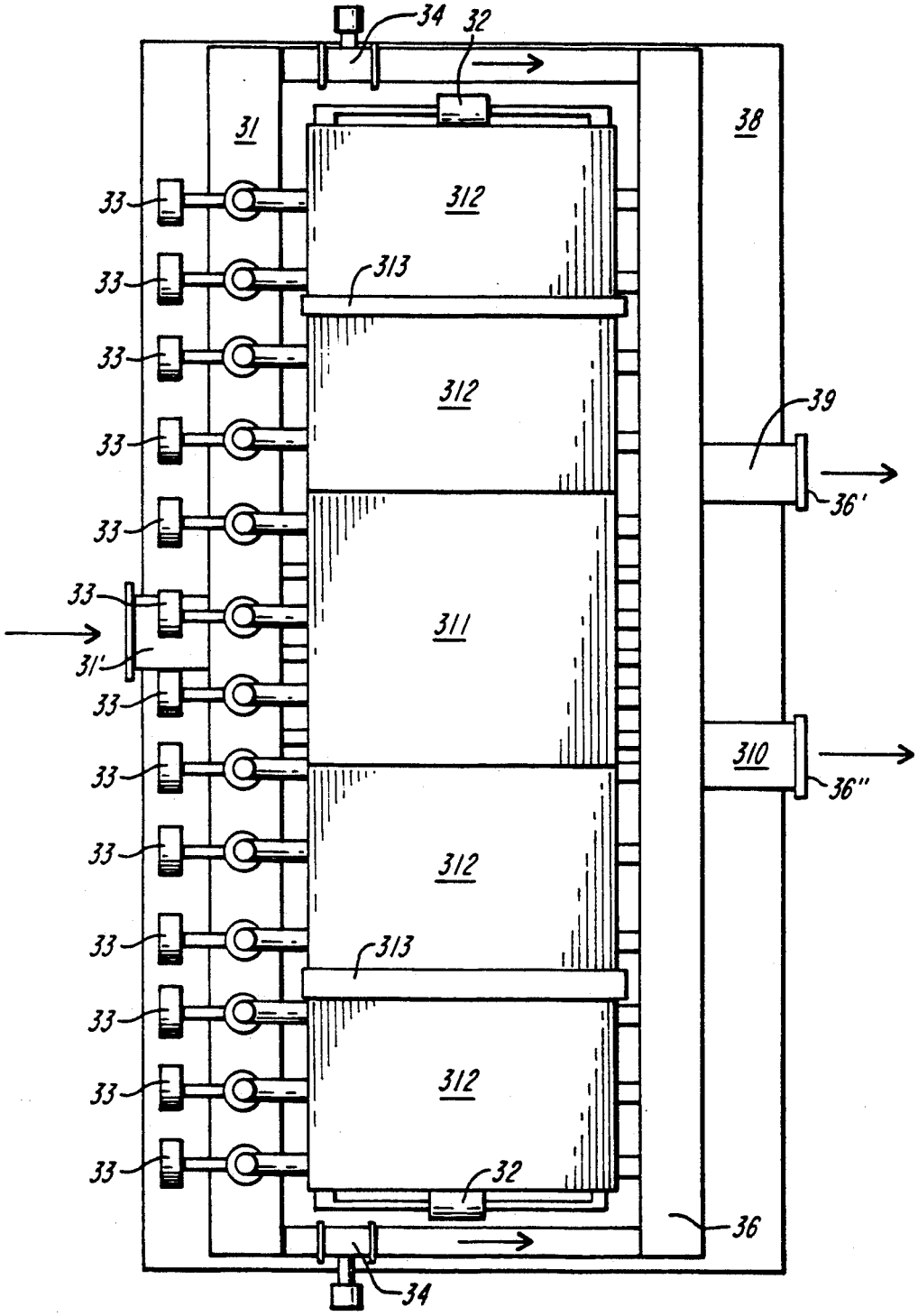
FIG. 3*b* is a top view of the vaporization and mixture regulation unit shown in FIG. 3*a;*
Figure 4A:
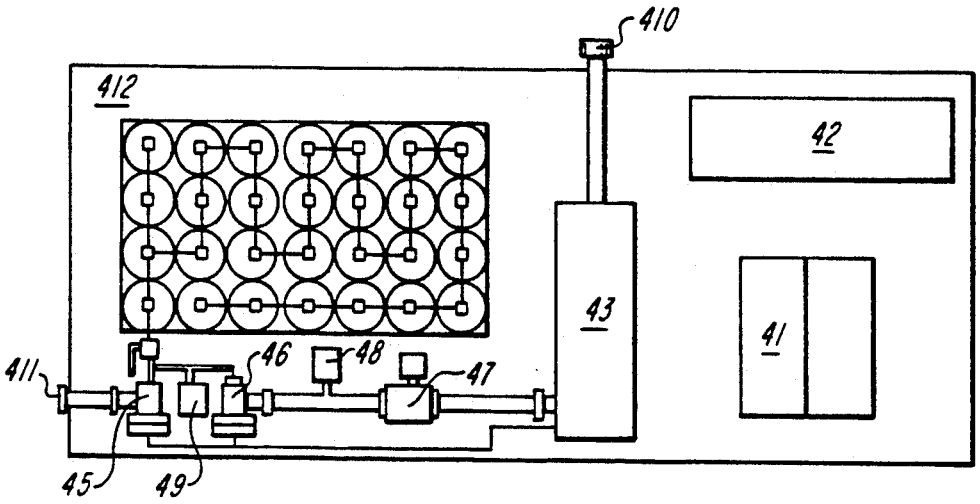
FIG. 4*a* is a top view of the command and control unit of the plant according to the present invention.
Figure 4B:
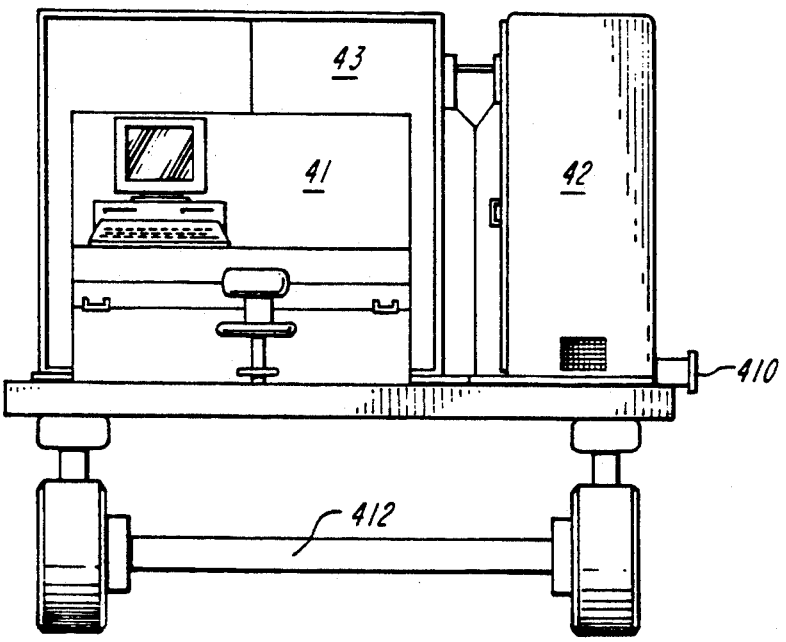
FIG. 4*b* is a rear elevational view of the command and control unit shown in FIG. 4*a;*

With reference to drawings, the plant for supplying nitrogen of the present invention, which comprises four interconnected units, will now be described as follows:

1—Liquid nitrogen supply unit.

This unit is basically formed by a tank 8 insulated by a vacuum chamber and filled with perlite with a capacity of 50 $m^3$. This tank is designed for storing nitrogen in liquid phase at a temperature of about −196° C. and at maximum pressure of about 405.2 kPa. It has a liquid nitrogen supplying capacity of about 600 $m^3/h$, due to the introduction in the nitrogen tank of nitrogen in the gaseous phase, through a reducer 1 with a capacity of about 600 to 700 $m^3/h$ and a globe valve 2 under the control of a pressostate 5 set for a pressure range from 0 to 1013 kPa for control of outlet pressure, the nitrogen in the gaseous phase from the vaporization and mixture regulation unit compensating the liquid nitrogen supplied by the unit through the outlet. For refilling the tank with liquid nitrogen, the tank is provided with a cryogenic needle type valve 7. The liquid nitrogen is transferred from the tank to the pumping unit, through a pneumatic piloted globe valve 2 and through first flexible interconnection pipes. This unit is mounted in a low profile truck 9, and further comprises a safety valve 10 set to 405.2 kPa, and a thermally insulated depressurized chamber 11 filled with perlite.

2—The pumping unit.

The pumping unit for liquid nitrogen comprises three electric pumps 21, 22 and 23, each powered with a 75 KW three phase electric motor and having a flow rate of 175 $m^3/h$ with a maximum differential pressure of 1013 kPa, a liquid nitrogen outlet duct 24 insulated with expanded polyurethane, a liquid nitrogen admission duct 25 connected to the pump inlet insulated with expanded polyurethane, a transportation carriage 26, a probe 27 for sensing temperature from −200° C. to over +30° C.

During the starting stage, the liquid nitrogen will be supplied to the pumping unit metered by valve 6 of the tank 8 until either the admission 25 and/or outlet 24 ducts reach a temperature of about −150° C. When the temperature probe 27 senses this temperature, it generates a correspondent signal to the control and command unit, which will then command the pumping unit that will start working, drawing up to 525 $m^3/h$ of liquid nitrogen and compressing it to the vaporization unit, where it will be vaporized mixed according to the required application.

3—Vaporization and mixture regulation unit.

The vaporization capacity of this unit is about 360,000 $m^3/h$ and it comprises a heat exchanger 312, in copper or aluminium. This heat exchanger 312 is set up inside a horizontal wind tunnel, through which passes air drawn by a ventilation assembly comprising two ventilators 32, each of which is powered by a 7.5 KW electric motor located at each end of the wind tunnel through an air inlet window 311 located in the top of the wind tunnel and midway from each ventilator 32. The liquid nitrogen compressed through the outlet pipe 24 of the pumping unit, enters through an admission pipe to the liquid nitrogen admission duct 31, insulated by expanded polyurethane 31, and passes through the pneumatically piloted cryogenic valves 33 to the heat exchanger 312 and then through the pneumatically piloted cryogenic valves 34 to the bypass circuits 35 for liquid nitrogen which extend under the exhaust duct 36 for gaseous nitrogen, and coming out through the exhaust ejectors 39 and 310, respectively, to the exhaust duct 36. The nitrogen in the gaseous phase, after being vaporized in the heat exchanger 312, passes through a plurality of pipes to the exhaust duct 36 and from there to the exhaust duct 36, where its temperature can vary between −100° C. and +20° C. with a predetermined moisture content provided by the ejectors 39 and 310 and with a pressure range from 588 to 1986 kPa. The referred mixture, under the control of the pneumatically piloted cryogenic valves 34, is the liquid nitrogen drawn in by the ejectors 39 and 310 due to the depression created by the flow of the gaseous nitrogen in the ejectors. The duct 36 is connected by a circuit (not shown) to the liquid nitrogen tank 8, that conveys the gaseous nitrogen through valve 2 and reducer 1. The wind tunnel frame rests on the base of the low profile truck 38, and is strengthened by means of two U-shaped frame supports 313, and is closed at the ends by end plates 37, that serve as supports for ventilators 32.

As described above, the two bypass circuits for liquid nitrogen which include the pneumatically piloted cryogenic valves 34 are an integral part of the vaporization and mixture regulation unit. The two bypass circuits extend under the outlet duct 36 and are connected to the ejectors 39 and 310, respectively, which are connected to the outlet ducts 36 which are connected to flexible distribution pipes (not shown). Under control of the central command and control unit, the valves 34 will open or close as necessary, thus allowing a mixture of nitrogen in the gaseous and liquid phases to be regulated, so that the installation may operate with variable atmospheric conditions, namely wind speed, air temperatures, etc.

4—Command and control unit.

This unit is designed for commanding and controlling all operating parameters of the plant and comprises:

A command and control console 41, comprising a programmable microprocessor, which allows the automatic and sequential operation of the plant under which all of the important operating parameters, such as pressures, temperatures, injection times, percentages of gaseous phase/liquid phase, etc., are controlled by software which is processed by the microprocessor.

an electrical board 42 controlled through the command and control console, in which all break and protection equipment for the main power lines are housed, either for the pumping unit or ventilator assemblies and for the motor of the filling pump (not shown) of tank 8;

a pneumatic board 43, controlled through the command and control console, in which is set up a set of circuits with the respective electrovalves necessary for the command of the electrovalves needed for the command of the pneumatically piloted valves, as well as the control of the different pressures controlled by such valves; and an air supply unit, comprising a battery of air pressurized bottles for pneumatically commanding the plant and for feeding air to the combustion engines of the power station and others considered necessary for the safe running of the plant; high flow rate reducers 45, 46; electrovalve 47 for stopping the air flow for operation; pressostate 48 for sensing low pressure air for operation; pressostate 49 for sensing the air pressure for the pneumatic board; outlet duct 411 for feeding the combustion engines of the derrick or other similar device.

The command and control unit is set in a transportation vehicle 412, that allows its movement.

Figure 5:
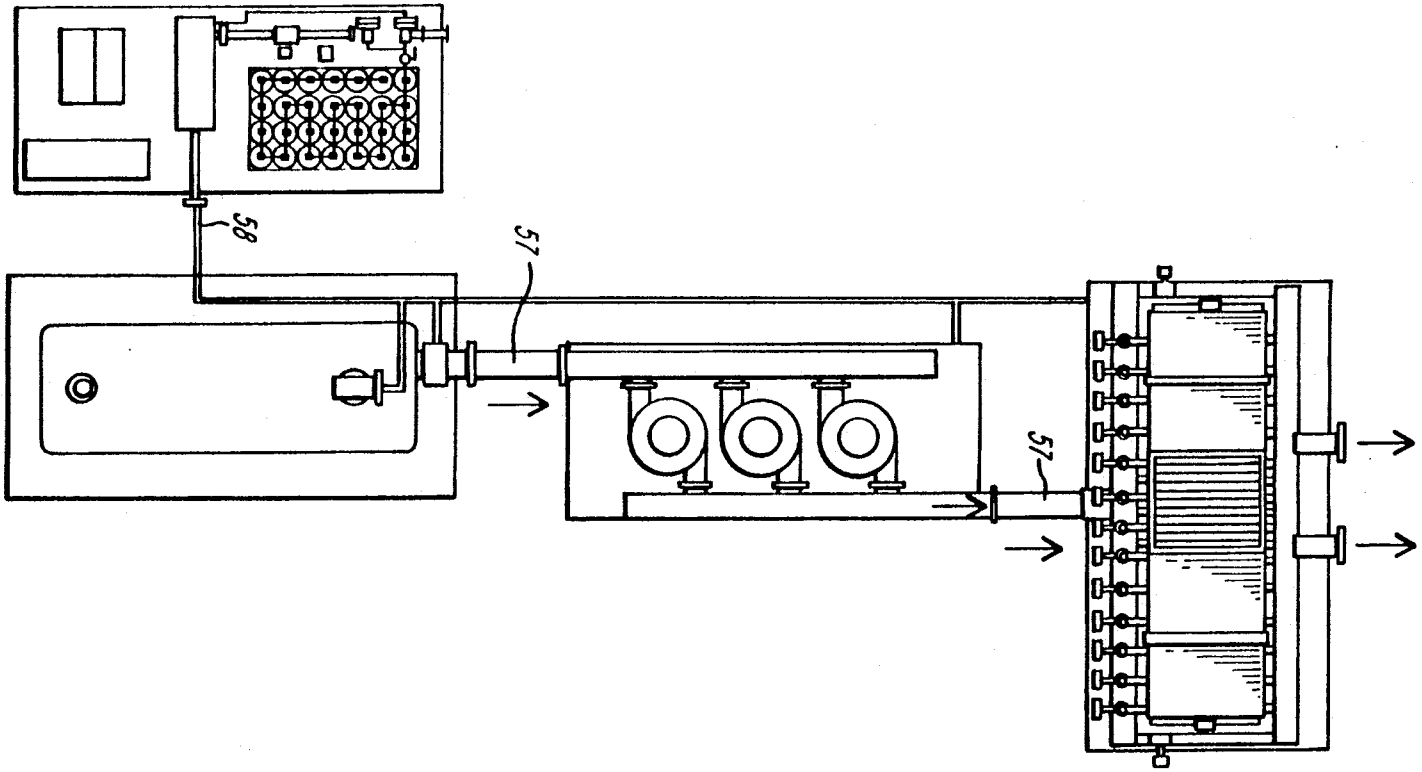
FIG. 5 is a top plan view of the plant for continuously supplying nitrogen, according to the present invention.

The plant for supplying liquid nitrogen, operating as described above and arranged according to the configuration represented in FIG. 5 also comprises:

a precooling circuit to prepare the plant for starting (not shown);

a compensation circuit (not shown), including valve 2 and a reducer 1 for the introduction of gaseous nitrogen in the tank 8, with the pressure conditions prevailing in the tank, and an inflow similar to the outflow of the nitrogen in liquid phase;

safety equipment for surveying the critical operating parameters or for stopping the plant to assure the safe operation of the plant, preferably comprising safety valves, alarms, gauges, break and protection devices, etc.;

command and control circuits 58, respectively connected to the power board 42 and the pneumatic command board 43, and to different parts of the plant, comprising piloting circuits for the valves, command circuits for the pumps, etc.; and flexible pipes 57 for interconnecting the referred different parts of the plant.

I claim:

1. A moveable plant for continuously distributing nitrogen to an apparatus that extinguishes fires in oil wells comprising:

(a) a high capacity thermally insulated tank, designed for storing nitrogen in liquid phase at a temperature of about −196° C. and at a maximum pressure of about 405 kPa, said tank having a first nitrogen inlet for filling said tank with nitrogen in liquid phase, a nitrogen inlet for filling said tank with nitrogen in liquid phase at about 600 $m^3/h$, and a second nitrogen inlet for filling said tank with nitrogen in a gaseous phase to compensate for a decrease in volume of the nitrogen in liquid phase when said nitrogen in liquid phase is discharged;

(b) a pumping unit connected to said tank for pumping liquid nitrogen from said tank, said pumping unit including at least three pumps each having a flow rate of 175 $m^3/h$ with a maximum differential pressure of 1013 kPa, an insulated liquid nitrogen outlet duct, an insulated liquid nitrogen inlet duct, and a probe for sensing the temperature in a temperature range from −200° C. to 30° C.;

(c) a vaporization and mixture regulation unit connected to said pumping unit for receiving nitrogen in gaseous and liquid phases from said pumping unit, said vaporization and regulation unit having a vaporization capacity up to 360,000 $m^3/h$ for liquid nitrogen and including at least interconnection pipes for transferring nitrogen in liquid phase from said vaporization and mixture regulation unit to said pumping unit, a heat exchanger to vaporize said nitrogen in liquid phase, a ventilation assembly to speed up and to maintain the vaporization of the said nitrogen in liquid phase and for supplying the heat needed for said vaporization, control valves to increase or reduce the flow rate of nitrogen through the heat exchanger, a phase mixture regulation means formed by said control valves, mixture regulation valves and mixture ejectors, an outlet duct for transferring nitrogen in gaseous phase or a mixture of nitrogen in liquid and gaseous phases where the temperature of said gaseous phase or a mixture of nitrogen in liquid and gaseous phases can vary from −100° C. to +20° C. and its pressure can vary from 588 to 1986 KPa; distribution circuits for connecting said vaporization and mixture regulation unit to a fire extinguishing apparatus;

(d) a power station for powering said plant; and (e) a control and command unit to command and control said plant, said control and command unit including a microprocessor to assure the automatic and sequential operation of the plant; electric control and command circuits and pneumatic control and command circuits comprising pilot circuits for the tank valves, command circuits for the pumping unit, command and control circuits for the vaporization and mixture regulation unit for nitrogen in gaseous and liquid phases and the power station.

2. The plant as claimed in claim 1, wherein said tank, said pumping unit, said vaporization and mixture regulation unit, and the said control and command unit are connected to each other by flexible pipes.

3. The plant as claimed in claim 1, wherein the said tank further comprises compensation circuits for introducing gaseous nitrogen in the said tank, said volume of inflow of gaseous nitrogen into said tank being approximately equal to the volume of outflow of nitrogen in the liquid phase from said tank while maintaining the pressure and temperature in said tank.

* * * * *